US007697020B2

(12) United States Patent
Yamade

(10) Patent No.: US 7,697,020 B2
(45) Date of Patent: Apr. 13, 2010

(54) THERMAL PRINT HEAD AND METHOD FOR MANUFACTURING SAME

(75) Inventor: Takumi Yamade, Kyoto (JP)

(73) Assignee: ROHM Co., Ltd., Kyoto (JP)

( * ) Notice: Subject to any disclaimer, the term of this patent is extended or adjusted under 35 U.S.C. 154(b) by 420 days.

(21) Appl. No.: 11/666,630

(22) PCT Filed: Oct. 28, 2005

(86) PCT No.: PCT/JP2005/019879

§ 371 (c)(1),
(2), (4) Date: Apr. 30, 2007

(87) PCT Pub. No.: WO2006/049095

PCT Pub. Date: May 11, 2006

(65) Prior Publication Data

US 2007/0296797 A1 Dec. 27, 2007

(30) Foreign Application Priority Data

Nov. 4, 2004 (JP) ..... 2004-320071

(51) Int. Cl.
*B41J 2/335* (2006.01)

(52) U.S. Cl. ..... 347/208

(58) Field of Classification Search ..... 347/200, 347/206, 208
See application file for complete search history.

(56) References Cited

U.S. PATENT DOCUMENTS

| | | | |
|---|---|---|---|
| 5,594,488 A | 1/1997 | Tsushima et al. | |
| 2002/0024582 A1 | 2/2002 | Shirakawa et al. | |

FOREIGN PATENT DOCUMENTS

| | | | | |
|---|---|---|---|---|
| CN | 1090568 | | 9/2002 | |
| JP | 62-49640 | | 3/1987 | |
| JP | 2-141262 | | 5/1990 | |
| JP | 4-47955 | * | 2/1992 | ..... 347/200 |
| JP | 7-96620 | | 4/1995 | |
| JP | 10-250128 | | 9/1998 | |
| JP | 2000-141728 | | 5/2000 | |
| JP | 2002-67367 | | 3/2002 | |

OTHER PUBLICATIONS

Computer-generated translation of JP 07-96620 published on Apr. 11, 1995.*
Computer-generated translation of JP 2000-141728, published on May 2000.*
International Search Report from the corresponding PCT/JP2005/019879, mailed Jan. 31, 2006.

* cited by examiner

*Primary Examiner*—Huan H Tran
(74) *Attorney, Agent, or Firm*—Hamre, Schumann, Mueller & Larson, P.C.

(57) ABSTRACT

A thermal printhead (A1) includes a substrate (1), a glaze layer (2), a heating resistor (3), an electrode (4) for energizing the heating resistor (3), the electrode being mainly composed of Au, and a protective film (6) covering the heating resistor (3) and the electrode (4). The electrode (4) has a surface formed with a plurality of recesses.

7 Claims, 8 Drawing Sheets

THERMAL PRINT HEAD AND METHOD FOR MANUFACTURING SAME

TECHNICAL FIELD

The present invention relates to a thermal printhead used for a thermal printer. The invention also relates to a method for manufacturing a thermal printhead.

BACKGROUND ART

Conventionally, as an apparatus for performing printing on a recording paper such as thermal paper, various thermal printheads have been proposed (See Patent Document 1 below for example). FIG. 11 of the present application shows an example of thermal printhead as related art of the present invention. Specifically, the illustrated thermal printhead B includes an insulating substrate 91, on which a glaze layer 92 made of glass, a heating resistor 93, an electrode 94 and a protective film 96 are laminated. The protective film 96 is made of a material mainly composed of glass. In printing using the thermal printhead B, recording paper such as thermal paper is moved relative to the printhead while being pressed against the protective film 96. In this process, heat generated at the heating resistor 93 is transferred to the recording paper, whereby appropriate printing is performed.

In the above-described thermal printhead, the electrode 94 can be made of a metal having excellent conductivity such as Al, Cu or Au. Of these metals, Au is a chemically stable material and has excellent corrosion resistance. Therefore, when the electrode 94 is made of Au, conduction failure due to the corrosion of the electrode can be avoided. Further, the electric resistance (resistivity) of Au is lower than that of Al and so on. Therefore, when the electrode 94 is made of Au, the amount of voltage drop is smaller than when Al is used, so that the power loss can be made smaller.

Although the electrode made of Au has the above-described advantages, it also has the following drawbacks. As compared with other highly conductive metals like Al, the adhesion of Au to glass which forms the protective film is poor. Therefore, the protective film may separate from the electrode 94, which leads to reduction of durability of the thermal printhead. Further, the difference in thermal expansion coefficient between the electrode and the protective film causes stress to be applied to the protective film, which promotes the separation of the protective film.

Patent Document 1: JP-A-2002-67367

DISCLOSURE OF THE INVENTION

The present invention is conceived under the above-described circumstances. It is, therefore, an object of the present invention to provide a thermal printhead in which the adhesion between an electrode made of Au and a protective film is enhanced. Another object of the present invention is to provide a method for making such a thermal printhead.

To solve the above-described problems, the present invention takes the following technical measures.

According to a first aspect of the present invention, there is provided a thermal printhead comprising a substrate, a glaze layer, a heating resistor, an electrode for energizing the heating resistor, the electrode being mainly composed of Au, and a protective film covering the heating resistor and the electrode. The electrode has a surface formed with a plurality of recesses.

With this structure, the adhesion between the electrode and the protective film can be enhanced. Specifically, by forming a plurality of recesses at the surface of the electrode, part of the protective film covering the electrode enters the recesses. As a result, the adhesion is enhanced due to the so-called anchoring effect. Further, due to the difference in thermal expansion coefficient between the electrode and the protective film, relatively large stress in the direction along the boundary surface of these may be applied to the protective film. According to the present invention, however, positional deviation in the direction along the boundary surface is unlikely to occur, which is advantageous for preventing the protective film from separating.

Preferably, the recesses are formed by making the surface of the electrode have center line average roughness Ra of 0.1 to 0.5 μm. With this structure, the above-noted anchoring effect is properly exhibited.

Preferably, the plurality of recesses comprise a plurality of penetrating portions which penetrate in the thickness direction of the electrode. Each of the penetrating portions may have a circular cross section. In this case, each of the through-holes has a diameter of 1 to 10 μm, for example. In the present invention, each of the penetrating portions may have a rectangular cross section instead of a circular cross section. In this case, the rectangle has shorter sides and longer sides, and the length of the shorter sides (width of the rectangle) may be 1 to 10 μm, for example. With this structure, part of the protective film entering the penetrating portion comes into direct close contact with the glaze layer or the heating resistor formed below the electrode. Since the glaze layer or the heating resistor has better adhesion to the protective film than the electrode has, the adhesion of the protective film is enhanced by bringing the glaze layer or the heating resistor into close contact with the protective film, whereby the separation of the protective film can be prevented.

Preferably, the thermal printhead according to the present invention further includes an insulating film formed on the lower side of the electrode. The insulating film has better adhesion to the protective film than the electrode has. Therefore, with this structure again, the adhesion of the protective film is enhanced by the direct close contact of part of the protective film entering the penetrating portion with the insulating film. This is advantageous for preventing the separation of the protective film.

According to a second aspect of the present invention, there is provided a thermal printhead comprising a substrate, a glaze layer, a heating resistor, an electrode for energizing the heating resistor, the electrode being mainly composed of Au, and a protective film covering the heating resistor and the electrode. A metal film containing at least one of Ni, Cr and Ti is formed on the electrode.

With this structure, similarly to the first aspect of the present invention, the adhesion between the electrode and the protective film can be enhanced. Specifically, metals such as Ni, Cr and Ti have better adhesion to the protective film than Au has. Therefore, by the provision of the metal film containing the above-described metals between the electrode and the protective film, the separation of the protective film can be prevented. Further, since the above-described metals have good adhesion to Au, the metal film does not unduly separate from the electrode.

According to a third aspect of the present invention, there is provided a method for making a thermal printhead. The method comprises the steps of forming a glaze layer on a substrate, forming an electrode mainly composed of Au on the glaze layer, forming a heating resistor, and forming a protective film for covering the heating resistor and the electrode. The method further comprises the step of heat-treating the substrate after the electrode formation step.

With this manufacturing method, the glass component of the glaze layer formed under the electrode diffuses to a portion adjacent to the obverse surface of the electrode. Since glass has better adhesion to the protective film than Au has, the glass component diffused to a portion adjacent to the obverse surface of the electrode functions as an adhesive, whereby the adhesion of the protective film is enhanced. As a result, the durability of the thermal printhead is enhanced.

Preferably, the method according to the present invention further comprises the step of forming a metal film containing at least one of Ni, Cr and Ti between the glaze layer and the electrode. With this method, the metal component of the metal film diffuses to a portion adjacent to the electrode. Since the metal has better adhesion to the protective film than Au has, the metal component diffused to a portion adjacent to the obverse surfaces of the electrode functions as an adhesive, whereby the adhesion of the protective film is enhanced.

Other features and advantages of the present invention will become clearer from the detailed description given below with reference to the accompanying drawings.

BRIEF DESCRIPTION OF THE DRAWINGS

FIG. 1A is a plan view schematically showing a principal portion of a thermal printhead according to a first embodiment of the present invention, whereas

FIG. 2A is a sectional view showing the thermal printhead of the first embodiment, whereas

BEST MODE FOR CARRYING OUT THE INVENTION

Preferred embodiments of the present invention will be described below with reference to the accompanying drawings.

Figure 1A:
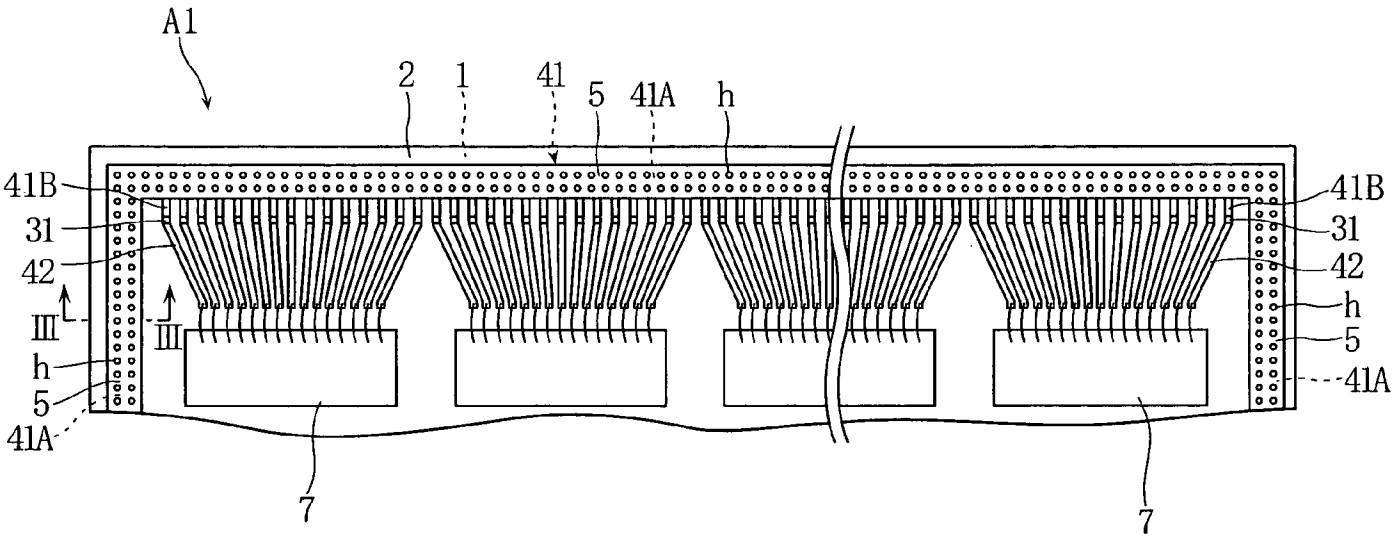
Figure 1B:
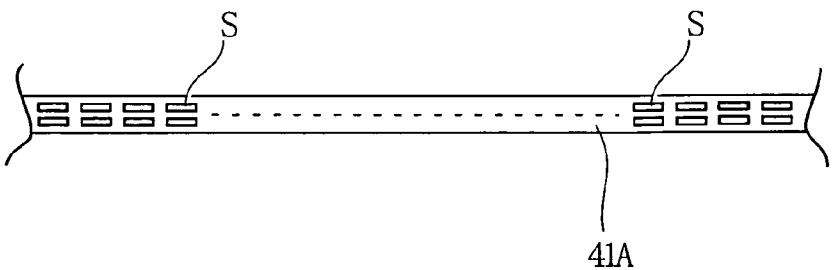
FIG. 1B is a partial plan view showing a variation of a common electrode.
Figure 2A:
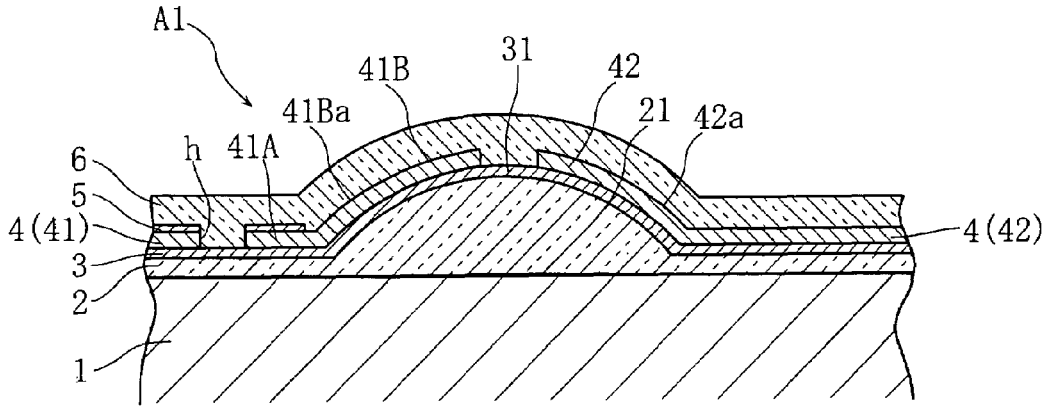
Figure 2B:
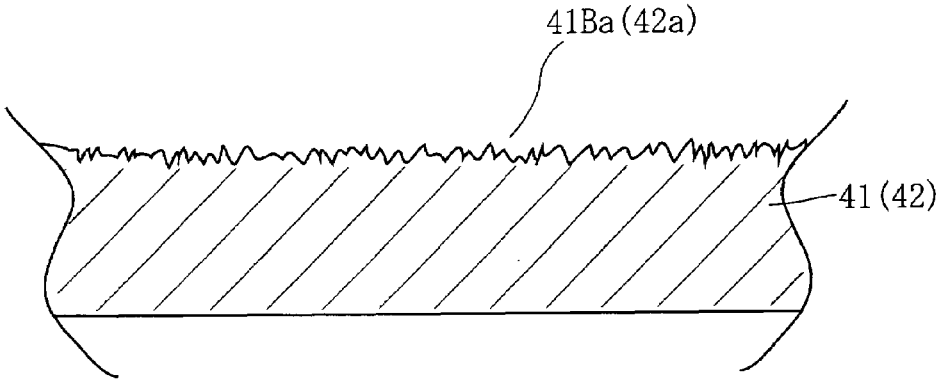
FIG. 2B is a sectional view schematically showing the surface of the common electrode and the individual electrode.
Figure 3:
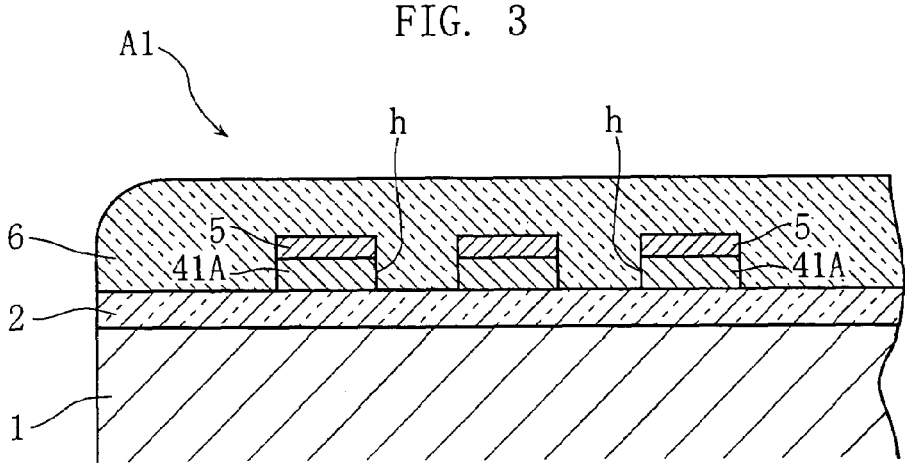
FIG. 3 is a sectional view taken along lines III-III in FIG. 1.

FIGS. 1-3 show a thermal printhead Al according to a first embodiment of the present invention. The thermal printhead Al includes a substrate 1, a glaze layer 2, a heating resistor 3, a common electrode 41, a plurality of individual electrodes 42, a metal film 5 and a protective film 6 (See FIG. 2A).

The substrate 1 comprises a flat plate which is in the form of an elongated rectangle in plan view and made of an insulating material such as alumina ceramic. The glaze layer 2, the heating resistor 3, an electrode layer 4 (electrodes 41 and 42), the metal film 5 and the protective film 6 are laminated on the substrate 1. The glaze layer 2 serves as a heat retaining layer. The glaze layer 2 also serves to provide a smooth surface appropriate for forming thereon the common electrode 3 and the individual electrodes 4. With this structure, the common electrode 3 and the individual electrodes 4 can be reliably fixed to the substrate 1. The glaze layer 2 is formed by printing and applying glass paste and then baking the paste. The glaze layer 2 includes a bulging portion 21, which has an arcuate outer surface. The heating resistor 3 may be provided by forming a $TaSiO_2$ film by CVD or sputtering, for example, and covers at least the bulging portion 21 of the glaze layer 2. For instance, the thickness of the heating resistor 3 is 0.2 to 2.0 μm. The electrode layer 4 is laminated on the upper side of the heating resistor 3 and may be provided by forming a film of a metal material mainly composed of e.g. Au by sputtering. For instance, the thickness of the electrode layer 4 is 0.3 to 2.0 μm. Part of the electrode layer 4 is selectively etched away by e.g. photolithography, whereby the common electrode 41 and the individual electrodes 42 are provided.

The common electrode 41 comprises a common line portion 41A and a plurality of extensions 41B. As shown in FIG. 1A, the common line portion 41A includes a portion (main portion) extending in the longitudinal direction of the substrate 1 and portions (sub portions) extending from the opposite ends of the main portion in the widthwise direction of the substrate 1. Each of the extensions 41B projects from the main portion of the common line portion 41A in the widthwise direction of the substrate 1. The common line portion 41A is a portion for causing current to flow collectively from a non-illustrated terminal to heating resistor elements 31, which will be described later, and has a relatively large area.

As shown in FIG. 2A, one end of each of the individual electrodes 42 is spaced from a respective one of the extensions 41B so that the heating resistor 3 is exposed at a portion adjacent to the top of the bulging portion 21 of the glaze layer 2. The other end of each of the individual electrodes 42 is electrically connected to a corresponding drive IC 7. The drives IC 7 serve to control energization based on the printing image data transmitted from the outside and are mounted on the substrate 1. When an individual electrode 42 is selectively energized by the drive IC 7, the exposed portion of the heating resistor 3 between the individual electrode 42 and the extension 41B facing the individual electrode functions as a heating resistor element 31 to form a single heating dot.

As shown in FIG. 2B, the surfaces 41Ba, 42*a* of the extensions 41B of the common electrode and the individual electrodes 42 are formed with a plurality of recesses. The recesses are formed by making the surfaces 41Ba, 42A irregular and rough. Preferably, the center line average roughness Ra of the surfaces 41Ba, 42*a* is 0.1 to 0.5 μm. Such irregularities can be formed by surface treatment such as light etching, for example.

The metal film 5 is laminated on the upper side of the common line portion 41A and formed by plating or sputtering of a metal material containing at least one of Ni, Cr and Ti. For instance, the thickness of the metal film 5 is 0.2 to 2.0 μm. The common line portion 41A and the metal film 5 are formed with a plurality of through-holes h which are circular in plan view (circular in cross section) as penetrating portions penetrating to the glaze layer 2 or the heating resistor 3 positioned therebelow. Preferably, the diameter of the through-holes h is 1 to 10 μm. The through-holes h may be formed by etching using a glass mask. As shown in FIG. 1B, as the penetrating portion, slits S having an elongated rectangular cross section may be formed instead of the through-holes h. Each of the slits S has shorter sides and longer sides.

The protective film 6 is formed to cover the heating resistor 3, the common electrode 41 and the individual electrodes 42 and made of $SiO_2$ or SiN, for example. The protective film 6 is formed by CVD or sputtering. For instance, the thickness of the protective film 6 is 3 to 10 μm. As better shown in FIGS. 2 and 3, part of the protective film 6 enters the through-holes h to come into direct close contact with the glaze layer 2 or the heating resistor 3.

The operation and advantages of the above-described thermal printhead A will be described below.

In the thermal printhead A of this embodiment, a plurality of recesses are formed at the surfaces 41Ba, 42*a* of the extensions 41B of the common electrode 41 and the individual electrodes 42. Therefore, part of the protective film 6 (formed on the upper side of the electrode layer 4) enters the recesses of the surfaces 41Ba, 42*a*, whereby the adhesion of the protective film 6 is enhanced by the anchoring effect. Therefore, the separation of the protective film 6 is prevented so that the durability of the thermal printhead A1 can be enhanced. In this embodiment, the anchoring effect is properly exhibited when the center line average roughness Ra of the surfaces 41Ba and 42*a* is 0.1 to 0.5 μm, which is suitable for preventing the separation of the protective film 6.

Due to the difference in thermal expansion coefficient between Au which forms the electrode layer 4 and glass which forms the protective film 6, relatively large stress in the direction along the boundary surface of these may be applied to the protective film 6. According to this embodiment, however, positional deviation in the direction along the boundary surface is unlikely to occur, which is advantageous for preventing the protective film from separating.

Since the metal film 5 containing any of Ni, Cr and Ti is formed on the upper side of the common line portion 41A of the common electrode 41, adhesion of the protective film 6 is enhanced. Specifically, as compared with Au, metals such as Ni, Cr or Ti have higher ionization tendency and are unstable, and hence, liable to form an oxide film on the surface. The existence of the oxide film enhances the adhesion to glass. Therefore, by providing the metal film 5 between the electrode layer 4 (common line portion 41A in this embodiment) and the protective film 6, the separation of the protective film 6 is prevented so that the durability of the thermal printhead is enhanced. Further, since the above-described metals have excellent adhesion to Au, the metal film 5 does not unduly separate from the electrode layer 4.

The through-holes h formed in the common line portion 41A and the metal film 5 extend up to the lower surface of the common line portion 41A. Part of the protective film 6 formed on the upper side of the common line portion 41A enters the through-holes h to come into direct close contact with the glaze layer 2 or the heating resistor 3 positioned therebelow. Since the glaze layer 2 or the heating resistor 3 has better adhesion to the protective film 6 than the electrode layer 4 has, the adhesion of the protective film 6 is enhanced by bringing the glaze layer 2 or the heating resistor 3 into close contact with the protective film 6, whereby the separation of the protective film 6 can be prevented. Moreover, since part of the protective film 6 enters the through-holes h, even when stress is generated at the protective film 6 in a direction along the boundary surface between the protective film and the underlying layer, positional deviation along the boundary surface is unlikely to occur. This is also advantageous for preventing the separation of the protective film 6. When the diameter of the through-holes h is 1 to 10 μm, the through-holes h can be properly filled with part of the protective film 6, while the sectional area of the common line portion 41A does not reduce extremely. As a result, an increase of the voltage drop at the common line portion 41A is suppressed, which is advantageous. As noted before, slits S (FIG. 1B) may be formed as the penetrating portion. In this case again, part of the protective layer 6 enters the slits S to come into direct close contact with the glaze layer 2 or the heating resistor 3, whereby the separation of the protective film 6 is prevented. Herein, it is preferable that each of the slits S extends generally perpendicularly to the width direction of the common line portion 41A and that the width of the slits S (dimension of the shorter side) is 1 to 10 μm. In this case, the sectional area of the common line portion 41A is not extremely reduced, so that an increase of the voltage drop at the common line portion 41A is suppressed.

The common line portion 41A of the common electrode 41 is a portion for causing current to flow collectively to each of the heating resistor elements 31 and formed to have a relatively large area.

Figure 4:
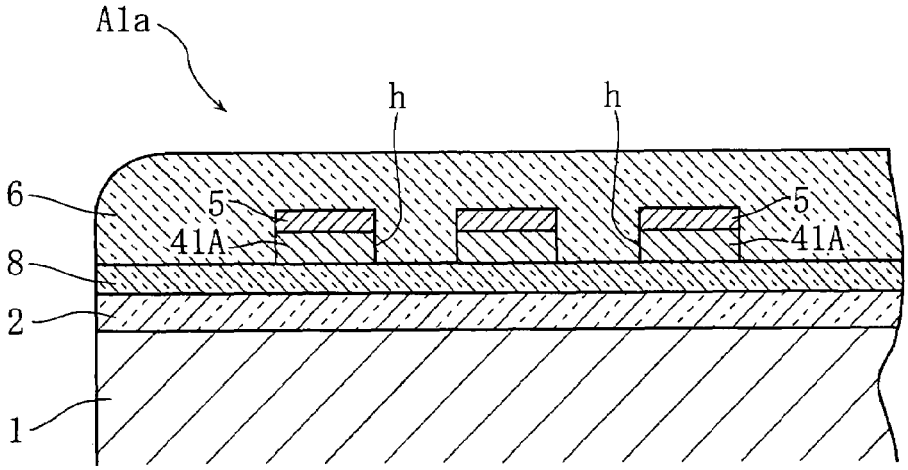
FIG. 4 is a sectional view showing a variation of the thermal printhead of the first embodiment.

FIG. 4 is a sectional view (corresponding to FIG. 3) showing a variation of the thermal printhead according to this embodiment. In the thermal printhead A1*a* shown in FIG. 4, an insulating film 8 is. provided on the lower side of the common line portion 41A. The insulating film 8 is formed by appropriately selecting a material having excellent adhesion to the material of the protective film 6 (e.g. $SiO_2$ or SiN) and may be made of $Ta_2O_5$, for example. Since the insulating film 8 has better adhesion to the protective film 6 than the electrode layer 4 has, the adhesion of the protective film 6 is enhanced by causing part of the protective film 6 to enter the through holes h to come into direct close contact with the insulating film 8, whereby the separation of the protective film 6 is prevented. Further, the insulating film 8 has better adhesion to the protective film 6 than the glaze layer 2 and the heating resistor 3 have. Therefore, as compared with the above-described thermal printhead A1, the adhesion of the protective film 6 in the thermal printhead A1*a* is enhanced also at the area where the electrode layer 4 is not formed on the insulating film 8. Therefore, in the thermal printhead A1*a*, the separation of the protective film 6 is enhanced further effectively.

Figure 5:
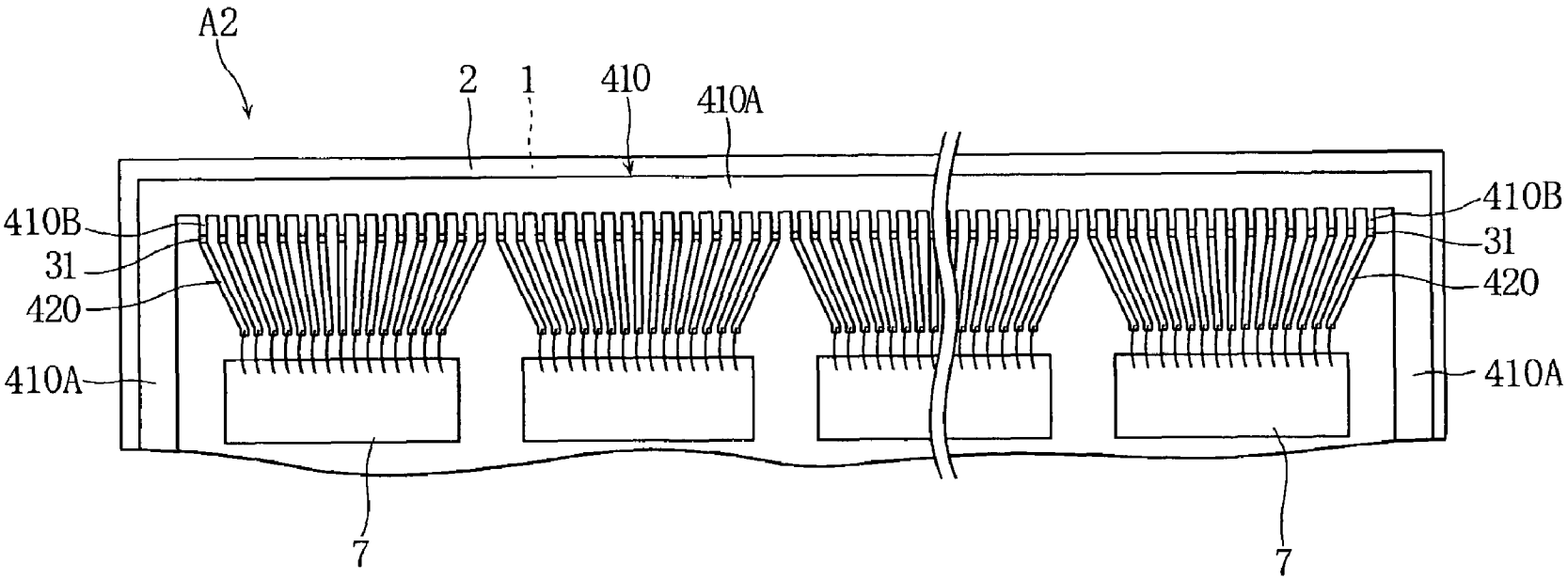
FIG. 5 is a plan view schematically showing a principal portion of a thermal printhead according to a second embodiment of the present invention.
Figure 6:
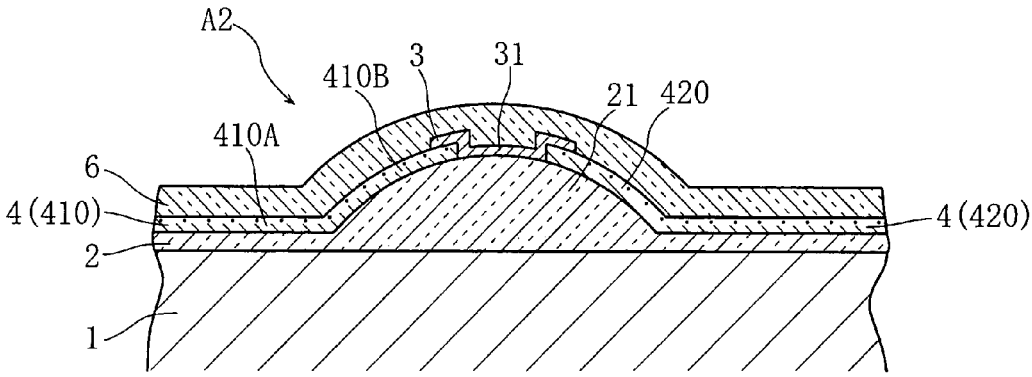
FIG. 6 is a sectional view showing the thermal printhead of the second embodiment.

FIGS. 5 and 6 show a thermal printhead A2 according to a second embodiment of the present invention. In FIG. 5 and the subsequent figures, the elements which are identical or similar to those of the first embodiment are designated by the same reference signs as those used for the first embodiment.

The thermal printhead A2 includes a substrate 1, a glaze layer 2, a heating resistor 3, a common electrode 410, a plurality of individual electrodes 420 and a protective film 6. In FIG. 5, the illustration of the protective film 6 is omitted.

The glaze layer 2, the electrode layer 4, the heating resistor 3 and the protective film 6 are successively laminated on the substrate 1. The glaze layer 2 includes a bulging portion 21 having a generally arcuate outer surface. The electrode layer 4 is laminated on the upper side of the glaze layer 2. Part of the electrode layer 4 is selectively etched away and heat-treated as will be described later, whereby the common electrode 410 and the individual electrodes 420 are provided.

The common electrode 410 has a shape similar to that of the first embodiment and includes a common line portion 410A and a plurality of extensions 410B. However, the common line portion 410A is not formed with a through-hole, which is the difference from the common electrode 41 of the first embodiment. Each of the individual electrodes 420 is spaced from a respective one of the extensions 410B so that the bulging portion 21 of the glaze layer 2 is exposed at a portion adjacent to the top of the bulging portion 21. In the common electrode 410 and the individual electrodes 420, the glass component of the glaze layer 2 positioned therebelow is diffused up to the portion adjacent to the obverse surfaces of the electrodes. In FIGS. 6 and 7-10, the glass component diffused up to a portion adjacent to the obverse surfaces of the electrodes is schematically indicated by dots. The diffusion of the glass component can be carried out by heat treatment, which will be described later.

The heating resistor 3 is formed on the upper side of the electrode layer 4. The heating resistor 3 is so formed as to cover the exposed portion of the bulging portion 21 of the glaze layer and bridge between an end of the extension 410B and an end of the individual electrode 420. Of the heating resistor 3, the exposed portion between the extension 410B and the individual electrode 420 facing the extension functions as a heating resistor element 31 and forms a single heating dot. In this way, the lamination structure of this embodiment differs from that of the first embodiment in that the heating resistor 3 is formed on the upper side of the electrode 4 and that the metal film 5 is not formed.

Figure 8A:
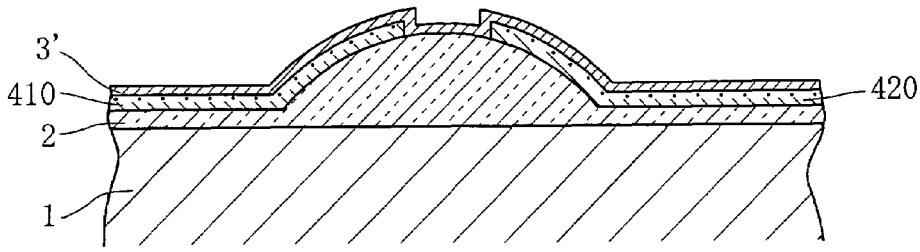
FIGS. 8A-8B are sectional views for describing the process steps following the steps of FIG. 7.
Figure 8B:
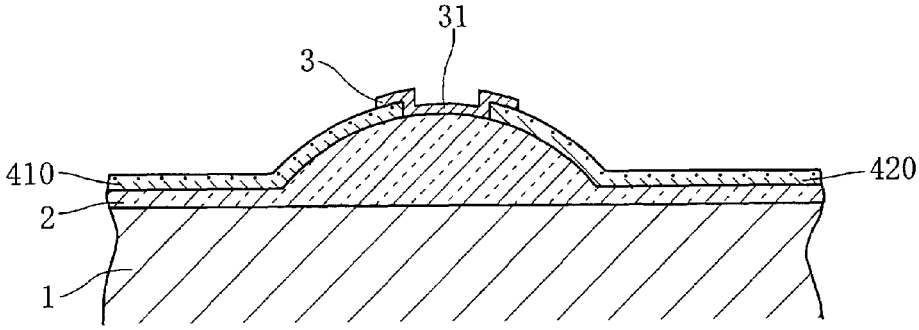
Figure 9:
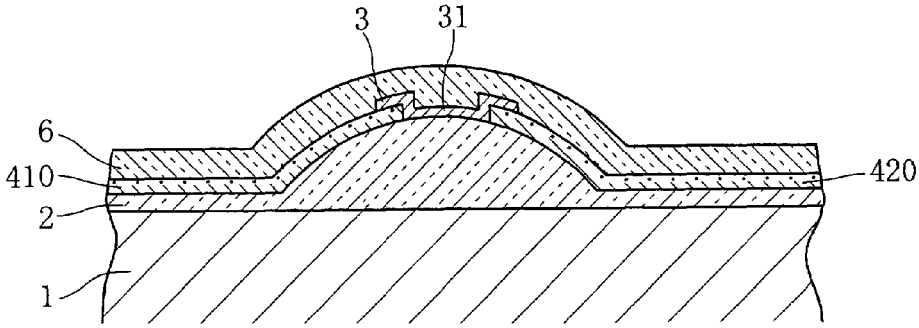
FIG. 9 is a sectional view for describing the process step following the steps of FIG. 8.

Referring to FIGS. 7-9, a method for manufacturing the thermal printhead A2 will be described below.

Figure 7A:
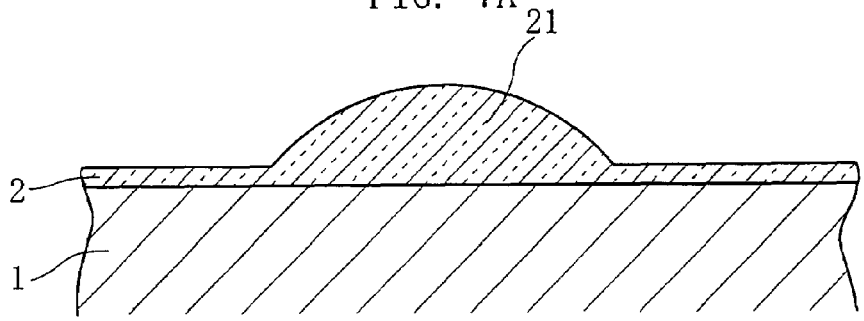
FIGS. 7A-7D are sectional views for describing a method for making the thermal printhead according to the second embodiment.
Figure 7B:
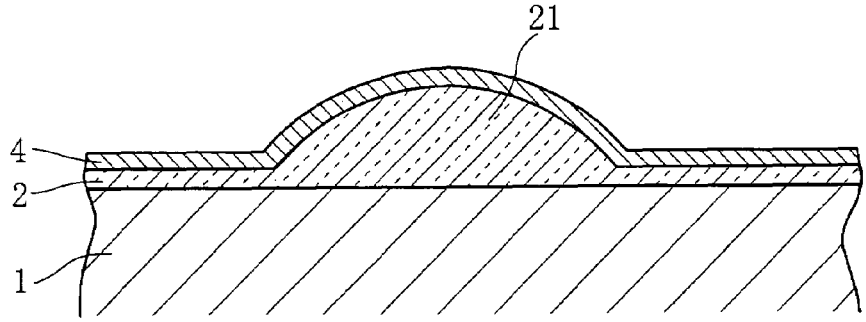
Figure 7C:
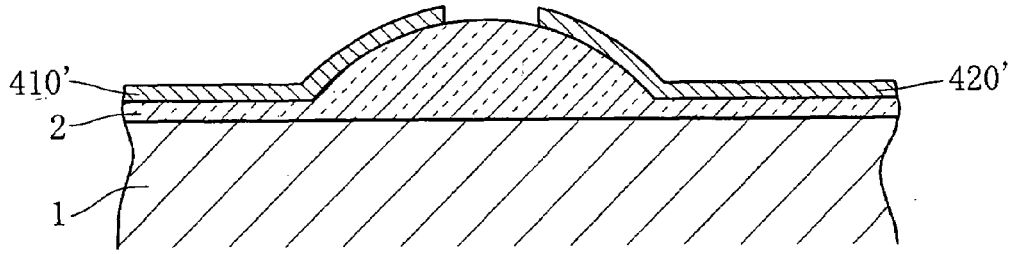

First, as shown in FIG. 7A, a glaze layer 2 is formed on a substrate 1 so as to include a bulging portion 21 having a generally arcuate outer surface. Specifically, the glaze layer 2 is formed by printing and baking glass paste. Subsequently, as shown in FIG. 7B, an electrode layer 4 is formed on the glaze layer 2. The electrode layer 4 is formed by printing and baking metal paste mainly composed of Au. Then, as shown in FIG. 7C, part of the electrode layer 4 is selectively etched away by e.g. photolithography, whereby a common electrode 410' and individual electrodes 420' are formed in which glass component is not diffused.

Figure 7D:
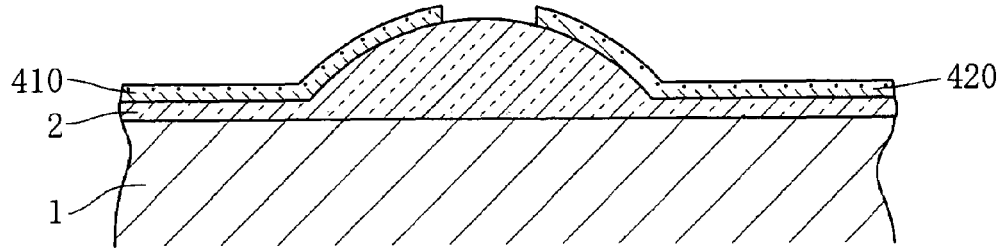

Subsequently, the substrate 1 is subjected to heat treatment at 800 to 900° C. for one hour, for example. Au which is the main ingredient of the electrode has a property that impurities are liable to diffuse. Therefore, as shown in FIG. 7D, the glass component of the glaze layer 2 diffuses into the common electrode 410' and the individual electrodes 420', whereby the common electrode 410' and the individual electrodes 420' containing the glass component at portions adjacent to the obverse surfaces thereof are provided.

Subsequently, as shown in FIG. 8A, a heating resistor layer 3' is formed. Specifically, the heating resistor layer 3' is provided by forming a film of $TaSiO_2$ by CVD or sputtering. Then, unnecessary portions of the heating resistor layer 3' are etched away, whereby the heating resistor 3 is provided, as shown in FIG. 8B.

Subsequently, as shown in FIG. 9, a protective film 6 is formed. Specifically, the protective film 6 is provided by forming a film of $SiO_2$ or SiN by CVD or sputtering.

According to this embodiment, the glass component of the glaze layer 2 is diffused to portions adjacent to the obverse surfaces of the common electrode 410 and the individual electrodes 420. Since glass has better adhesion to the protective film 6 than Au has, the glass component diffused to portions adjacent to the obverse surfaces of the common electrode 410 and the individual electrodes 420 functions as an adhesive, whereby the adhesion of the protective film 6 is enhanced. Therefore, the durability of the thermal printhead A2 is enhanced.

Figure 10:
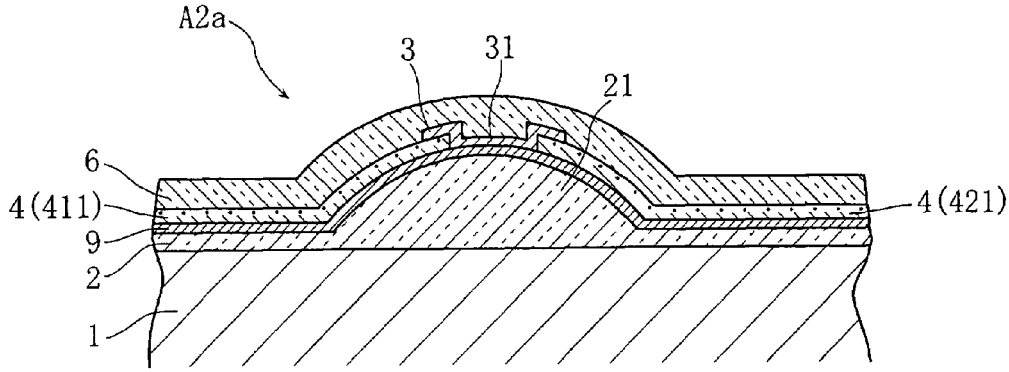
FIG. 10 is a sectional view showing a variation of the thermal printhead of the second embodiment.
Figure 11:
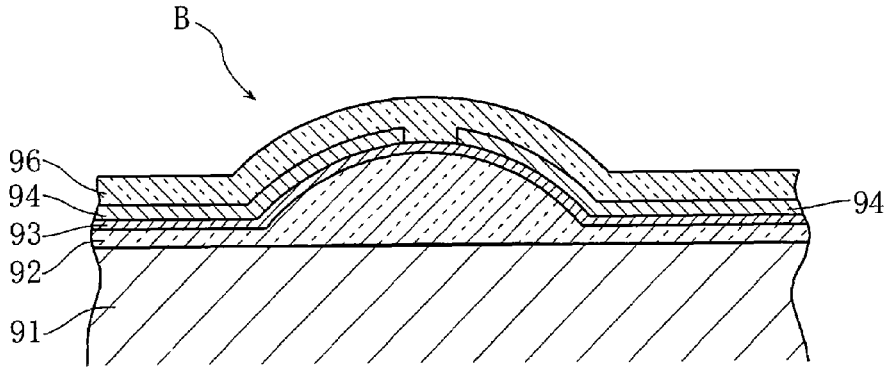
FIG. 11 is a sectional view showing an example of thermal printhead as a related art of the present invention.

FIG. 10 is a sectional view showing a variation of the thermal printhead according to the second embodiment. In the thermal printhead A2*a* shown in FIG. 10, a metal film 9 is formed between the glaze layer 2 and the electrode layer 4 by sputtering, for example. Specifically, the metal film 9 is provided by forming a film of metal containing any of Ni, Cr and Ti on the glaze layer 2 by sputtering, for example. In this thermal printhead A2*a*, by performing heat treatment after the formation of the electrodes as noted above, the metal component contained in the metal film 9 is diffused to portions adjacent to the obverse surfaces of the common electrode 411 and the individual electrodes 421. Since the above-described metal has better adhesion to the protective film 6 than Au has, the metal component diffused up to the portions adjacent to the obverse surfaces of the common electrode 411 and the individual electrodes 421 functions as an adhesive, whereby the adhesion of the protective film 6 is enhanced. For some kinds of protective film 6, the metal component of the metal film 9 has better adhesion to the protective film 6 than the glass component of the glaze layer 2 has, and the thermal printhead A2*a* is suitable for such a case. In the thermal printhead A2*a* again, by forming the metal film 9 as a thin film having a thickness smaller than a predetermined value, the glass component of the glaze layer 2 can be diffused up to the portions adjacent to the obverse surfaces of the common electrode 411 and the individual electrodes 421.

The present invention is not limited to the foregoing embodiments. For example, the recesses at the electrode are not necessarily be formed by etching but may be formed by other techniques such as sandblasting or by the use of a stepper.

In the first electrode, the formation of recesses by light etching may be performed with respect to only part of the electrode or the entirety of the electrode. Similarly, the formation of the metal film 5 or the through-holes h may be performed with respect to only part of the electrode or the entirety of the electrode.

In the present invention, the penetrating portion is not limited to a through-hole which is circular in plan view or a slit which is in the form of an elongated rectangle in plan view. The shape, number, arrangement and so on of the penetrating portions can be varied appropriately.

The protective film is not limited to that having a single layer structure as described in the foregoing embodiments. The protective film may comprise the lamination of two or more layers including a corrosion resistant layer. Further, the thermal printhead according to the present invention may be of a thin film type or a thick-film type.

The invention claimed is:

1. A thermal printhead comprising: a substrate; a glaze layer; a heating resistor; an electrode for energizing the heating resistor, the electrode being mainly composed of Au; and a protective film covering the heating resistor and the electrode;

wherein the electrode has a surface formed with a plurality of recesses; and wherein the plurality of recesses comprise a plurality of penetrating portions that penetrate in a thickness direction of the electrode.

2. The thermal printhead according to claim 1, wherein part of the recesses is formed by making the surface of the electrode have center line average roughness Ra of 0.1 to 0.5 μm.

3. The thermal printhead according to claim 1, wherein each of the penetrating portions has a circular cross section.

4. The thermal printhead according to claim 3, wherein each of the penetrating portions has a diameter of 1 to 10 μm.

5. The thermal printhead according to claim 1, wherein each of the penetrating portions has a rectangular cross section.

6. The thermal printhead according to claim 5, wherein the rectangle has shorter sides and longer sides, and length of the shorter sides is 1 to 10 μm.

7. The thermal printhead according to claim 1, further comprising an insulating film formed on a lower side of the electrode.

* * * * *